US007107955B2

(12) United States Patent
Mori et al.

(10) Patent No.: US 7,107,955 B2
(45) Date of Patent: Sep. 19, 2006

(54) AUXILIARY FUEL INJECTION UNIT IN INTERNAL COMBUSTION ENGINE AND CONTROL DEVICE FOR AUXILIARY FUEL INJECTION UNIT

(75) Inventors: Katsuyuki Mori, Anjo (JP); Tatsushi Nakashima, Anjo (JP); Motoki Ohtani, Toyota (JP)

(73) Assignees: Nippon Soken, Inc., Nishio (JP); Toyota Jidosha Kabushiki Kaisha, Toyota (JP)

( * ) Notice: Subject to any disclaimer, the term of this patent is extended or adjusted under 35 U.S.C. 154(b) by 78 days.

(21) Appl. No.: 11/010,453

(22) Filed: Dec. 14, 2004

(65) Prior Publication Data

US 2005/0132995 A1 Jun. 23, 2005

(30) Foreign Application Priority Data

Dec. 22, 2003 (JP) ..... 2003-425424

(51) Int. Cl.
*F02N 17/00* (2006.01)
*F02M 69/00* (2006.01)
*F02M 51/06* (2006.01)

(52) U.S. Cl. ..... 123/179.14; 123/179.7

(58) Field of Classification Search ..... 123/179.14, 123/179.7, 6.85

See application file for complete search history.

(56) References Cited

U.S. PATENT DOCUMENTS 5,027,769 A * 7/1991 Yoshida et al. ..... 123/399
6,986,331 B1 * 1/2006 Mizutani ..... 123/179.15
2004/0007209 A1 * 1/2004 Ohtani ..... 123/431

FOREIGN PATENT DOCUMENTS

JP A 58-107831 6/1983
JP A 02-049952 2/1990
JP A 11-294225 10/1999
JP A 2001-152926 6/2001

* cited by examiner

*Primary Examiner*—Stephen K. Cronin
*Assistant Examiner*—Arnold Castro
(74) *Attorney, Agent, or Firm*—Oliff & Berridge, PLC

(57) ABSTRACT

An auxiliary fuel injection unit includes two surge tanks partitioned by a wall surface, a butterfly valve for switching between connection and disconnection of two surge tanks, and one auxiliary fuel injection valve for injecting an auxiliary fuel in a direction opposing a direction of flow of intake air within the surge tank. The butterfly valve has a valve plate surface closing an opening provided in the surge tank wall surface and a rotation shaft for turning the plate surface. The auxiliary fuel injection valve has two injection holes connecting with each other, for injecting the auxiliary fuel toward the valve plate surface of the butterfly valve and toward the surge tank wall surface.

24 Claims, 10 Drawing Sheets

AUXILIARY FUEL INJECTION UNIT IN INTERNAL COMBUSTION ENGINE AND CONTROL DEVICE FOR AUXILIARY FUEL INJECTION UNIT

This nonprovisional application is based on Japanese Patent Application No. 2003-425424 filed with the Japan Patent Office on Dec. 22, 2003, the entire contents of which are hereby incorporated by reference.

FIELD OF THE INVENTION

The present invention relates to a technology for fuel supply in an internal combustion engine, and more particularly to an auxiliary fuel injection unit attaining excellent starting property at the time of cold start as well as a control device for the same.

DESCRIPTION OF THE BACKGROUND ART

In an internal combustion engine, in particular in a multi-cylinder engine for a vehicle, a plurality of inlet pipes in the number corresponding to the number of the cylinders are provided for supplying air to a cylinder, and the internal combustion engine includes a surge tank connecting to the plurality of gathered inlet pipes. In addition, an electronically controlled fuel injection unit drives an auxiliary fuel injection valve called a cold start injector at the time of cold start, so as to attain excellent starting property (ignition quality, exhaust emission, or the like). The cold start injector is generally provided in the surge tank, and controlled in synchronization with a start switch based on detection of a temperature of engine cooling water. Normally, a single cold start injector is provided. Here, for uniform supply of a starter auxiliary fuel to all cylinders with a single cold start injector, whether or not an attachment position or a fuel injection direction of the cold start injector is appropriate is a factor significantly affecting the starting property.

Normally, one cold start injector having one injection hole is provided in the vicinity of a central portion of the surge tank, so as to inject the auxiliary fuel in a direction attaining uniform distribution of the fuel to all cylinders. In an inlet pipe having an asymmetrical shape, however, distribution of the auxiliary fuel tends to be unbalanced with only one cold start injector. Specifically, the auxiliary fuel is distributed more in a direction of travel of injection or in a direction of flow of intake air. In addition, in an engine having a surge tank including a plurality of chambers, it is difficult to uniformly supply the starting fuel to all cylinders without delay using one cold start injector. Publications shown below disclose related arts with regard to such a cold start injector.

Japanese Patent Laying-Open No. 58-107831 (document 1) discloses an appropriate position of a cold start injector in an internal combustion engine, in which when a load to the internal combustion engine is small, supply of a fuel and intake air to operating cylinders is cut off and exhaust is returned to non-operating cylinders, so as to perform a partial cylinder operation. A partial operation control type internal combustion engine disclosed in document 1 cuts off fuel supply and intake air into the operating cylinders when a light load is applied to the engine using an intake shut-off valve provided in an inlet pipe path through which an operation-side surge tank connecting to gathered inlet pipes of operating cylinders connects with an inlet-side surge tank connecting to gathered inlet pipes of the non-operating cylinders and returns the exhaust to the non-operating cylinders, so as to perform a partial cylinder operation. A cold start injector is disposed in the inlet pipe path, and a starter auxiliary fuel injected from the cold start injector impinges perpendicularly on a valve wall surface of the intake shut-off valve.

With the partial operation control type internal combustion engine, the starter auxiliary fuel injected from the cold start injector impinges perpendicularly on the valve wall surface of the intake shut-off valve, and the auxiliary fuel is reliably atomized and diffused so that it is uniformly distributed to the operating cylinders and the non-operating cylinders, thereby reducing a starting time. Here, oil mist or deposit adhered on a valve element surface is blown off, so that the valve element surface and an area around a valve shaft are constantly maintained clean, thereby preventing lowering of a shut-off function of the intake shut-off valve.

Japanese Patent Laying-Open No. 11-294225 (document 2) discloses a fuel injection unit for an internal combustion engine attaining a function for excellent distribution of a fuel using an auxiliary fuel injection valve shared by cylinders at the time of cold start and under high load. In the fuel injection unit for the internal combustion engine, an air intake path connecting to each cylinder is branched, and a collector extends in a direction of a cylinder row, through which one end, intake air is introduced. The fuel injection unit includes fuel supply means for injecting a fuel toward downstream with respect to an intake air current at least at the time of start and for injecting the fuel toward upstream with respect to the intake air current at least during a prescribed high-load operation, the fuel supply means being arranged on an intake air introduction side of the collector.

With the fuel injection unit for the internal combustion engine, at the time of start, in particular immediately after cranking, each cylinder takes in air that has originally been present in the collector. Accordingly, the fuel is injected from the upstream toward the downstream of the collector. That is, the entire air that has originally been present in the collector is mixed with fuel spray, whereby excellent starting property is attained. On the other hand, in the high-load operation, the fuel is injected toward the upstream so as to oppose to the intake air current. In this manner, the fuel can be distributed over a wide range on a cross-section of the intake air current, and mixing of the intake air current with the fuel spray is promoted, thereby attaining excellent distribution of the fuel to each cylinder.

On the other hand, in the partial operation control type internal combustion engine disclosed in document 1 described above, the auxiliary fuel injected from the cold start injector is carried away by the intake air flow, resulting in high concentration of an atmosphere in the downstream of the shut-off valve. That is, it is difficult to uniformly supply the auxiliary fuel to all cylinders.

In the fuel injection unit for the internal combustion engine disclosed in document 2, at the time of cold start, the fuel is injected from the cold start injector toward the downstream (cylinder side) of the intake air current. With such injection, however, it takes time for the auxiliary fuel to reach each cylinder, and starting with excellent response cannot be realized. In addition, as the inlet pipe has an asymmetrical shape, it is difficult to uniformly distribute the auxiliary fuel to each cylinder.

An engine having six cylinders or more sometimes adopts a variable induction system called ACIS (Acoustic Control Induction System). Here, pressure fluctuation occurs in the inlet pipe due to indirect intake strokes. The pressure fluctuation that still remains in the inlet pipe even after an intake valve is closed causes a pulsing effect, which in turn affects a next intake stroke. If the pressure fluctuation that remains after the intake valve is closed is in synchronization with the next intake stroke, a pressure at the time of opening of the valve is raised and an amount of intake air is increased, thereby improving a torque. In order to positively utilize this pulsation effect, the variable induction system switches an effective length of the inlet pipe path in accordance with a cycle of a pulsating flow that varies in accordance with an engine speed, so as to improve the torque at every engine speed.

Such a variable induction system is implemented, for example, by providing a partition wall in the surge tank, providing a valve of a butterfly type on the partition wall, and virtually varying an interval between cylinders by opening/closing the valve. In other words, two virtual lengths of an intake manifold are switched in order to improve intake efficiency in an entire range from low speed to high speed, thereby improving the torque.

The surge tank adopting such a variable induction system is constituted of a plurality of chambers. With the surge tank of such a shape, it is particularly difficult to uniformly supply the starter fuel to all cylinders without delay with a single cold start injector. Since a solution by increasing the number of the cold start injectors causes cost increase, adoption thereof is less likely.

SUMMARY OF THE INVENTION

An object of the present invention is to provide an auxiliary fuel injection unit for an internal combustion engine attaining improvement in a cold start property, in an internal combustion engine having a variable inlet pipe length system.

Another object of the present invention is to provide a control device for an auxiliary fuel injection unit for an internal combustion engine attaining improvement in a cold start property, in an internal combustion engine having a variable inlet pipe length system.

An auxiliary fuel injection unit in an internal combustion engine according to the present invention includes: a plurality of surge tanks partitioned by a wall surface; a valve for switching between connection and disconnection of the surge tanks; and an auxiliary fuel injection valve for injecting an auxiliary fuel in a direction opposing a direction of flow of intake air within the surge tank. The auxiliary fuel injection valve has an injection hole for injecting the auxiliary fuel toward the valve and toward the wall surface.

According to the present invention, the auxiliary fuel injection valve injects the auxiliary fuel in a direction opposing the direction of the flow of the intake air. Accordingly, instantaneous suction of a large amount of auxiliary fuel in a specific cylinder as is the case in injection of the auxiliary fuel along the flow can be avoided and uniform distribution of the auxiliary fuel to a plurality of cylinders can be achieved. The variable inlet pipe length system is constituted of a plurality of surge tanks partitioned by the wall surface and a valve for switching between connection and disconnection of the surge tanks. The auxiliary fuel is injected toward the plate surface of the valve and toward the wall surface through the injection hole of the auxiliary fuel injection valve. Therefore, the auxiliary fuel is divided into two: auxiliary fuel injected in the direction opposing the direction of the flow of the intake air and directly supplied to each cylinder (without reaching the plate surface of the valve and the wall surface); and auxiliary fuel injected toward the plate surface of the valve and toward the wall surface, once adhered to those surfaces, and thereafter supplied to each cylinder in a vaporized manner. In particular, when the auxiliary fuel impinges on those surfaces, the auxiliary fuel may be atomized and diffused, thereby attaining uniform supply of the auxiliary fuel to each cylinder. By balancing these factors, suction of a large amount of auxiliary fuel in a specific cylinder can be avoided, and uniform supply of the auxiliary fuel to all cylinders can be achieved. As a result, an auxiliary fuel injection unit for an internal combustion engine attaining improvement in a cold start property can be provided in an internal combustion engine having a variable inlet pipe length system.

Preferably, the valve is implemented by a butterfly valve opening and closing an opening provided around a central portion of the surge tank.

According to the present invention, the auxiliary fuel is injected to the plate surface of the butterfly valve and the wall surface constituting the variable inlet pipe length system. Therefore, the auxiliary fuel is divided into two: auxiliary fuel injected in the direction opposing the direction of the flow of the intake air and directly supplied to each cylinder (without reaching the plate surface of the valve and the wall surface); and auxiliary fuel injected toward the plate surface of the valve and toward the wall surface, once adhered to those surfaces, and thereafter supplied to each cylinder in a vaporized manner. By balancing these factors, suction of a large amount of auxiliary fuel in a specific cylinder can be avoided, and uniform supply of the auxiliary fuel to all cylinders can be achieved.

More preferably, the auxiliary fuel injection valve has a shaft portion extending in a direction perpendicular to the rotation shaft, and the shaft portion has two injection holes aligned in a direction in which the shaft portion extends. A first injection hole opens toward the plate surface of the valve and a second injection hole opens toward the wall surface.

According to the present invention, the auxiliary fuel injection valve has two injection holes. The first injection hole opens toward the plate surface of the valve and the second injection hole opens toward the wall surface. Therefore, the auxiliary fuel is injected from the first injection hole toward the plate surface of the valve and from the second injection hole toward the wall surface. Then, the auxiliary fuel once impinges on those surfaces, and thereafter the auxiliary fuel may be supplied to each cylinder in an atomized and diffused manner, or the auxiliary fuel may be once adhered to those surfaces, and thereafter supplied to each cylinder in a vaporized manner.

Further preferably, the two injection holes connect with each other.

According to the present invention, two injection holes connect with each other and open toward the direction opposing the flow of the intake air. Therefore, removal of the fuel in the injection hole is facilitated, and solidification of remaining fuel due to chemical reaction and adhesion of a combustion product in a gas blown into the surge tank can be prevented.

Further preferably, a direction of injection of the auxiliary fuel through the injection hole is set to be in parallel to the flow of the intake air and in a range from the direction opposing the flow of the intake air to a direction of the plane including the valve and the wall surface.

According to the present invention, the auxiliary fuel is injected in parallel to the flow of the intake air and in a range from the direction opposing the flow of the intake air to a direction of the plane including the valve and the wall surface. The auxiliary fuel injected in such a range is divided into two: auxiliary fuel directly supplied to each cylinder;

and auxiliary fuel injected toward the plate surface of the valve and toward the wall surface, once adhered to those surfaces, and thereafter supplied to each cylinder in a vaporized manner. Accordingly, the auxiliary fuel can uniformly be supplied to all cylinders.

Further preferably, as the auxiliary fuel injection valve is distanced from the valve and the wall surface, an angle defined by the direction of injection of the auxiliary fuel and the plane in which the valve and a partition wall are arranged is set to be large.

According to the present invention, as the auxiliary fuel injection valve is distanced from the valve and the wall surface, that is, as the auxiliary fuel injection valve is provided in a further upper portion of the surge tank, a time for the auxiliary fuel to reach the plate surface of the valve and the wall surface after injection is extended. Accordingly, a force applied by the flow of the intake air becomes larger than a force of travel of the auxiliary fuel. Here, the angle defined by the direction of injection of the auxiliary fuel and the plane in which the valve and the partition wall are arranged is set to be large, so that the injected auxiliary fuel readily reaches the plate surface of the valve and the wall surface. In this manner, the injected auxiliary fuel is divided into two: auxiliary fuel directly supplied to each cylinder; and auxiliary fuel injected toward the plate surface of the valve and toward the wall surface, once adhered to those surfaces, and thereafter supplied to each cylinder in a vaporized manner. Accordingly, the auxiliary fuel can uniformly be supplied to all cylinders.

Further preferably, as an angle of spread of spray of the auxiliary fuel through the injection hole of the auxiliary fuel injection valve is large, an angle defined by the direction of injection of the auxiliary fuel and the plane in which the valve and a partition wall are arranged is set to be large.

According to the present invention, as an angle of spread of spray of the auxiliary fuel through the injection hole of the auxiliary fuel injection valve is large, the auxiliary fuel is less likely to reach the plate surface of the valve and the wall surface after injection. Here, the angle defined by the direction of injection of the auxiliary fuel and the plane in which the valve and the partition wall are arranged is set to be large, so that the injected auxiliary fuel readily reaches the plate surface of the valve and the wall surface. In this manner, the injected auxiliary fuel is divided into two: auxiliary fuel directly supplied to each cylinder; and auxiliary fuel injected toward the plate surface of the valve and toward the wall surface, once adhered to those surfaces, and thereafter supplied to each cylinder in a vaporized manner. Accordingly, the auxiliary fuel can uniformly be supplied to all cylinders.

Further preferably, if injection of the auxiliary fuel by the auxiliary fuel injection valve is used in an area where an engine speed of the internal combustion engine is high, or in an area where a manifold pressure is high, or in an area where an amount of intake air per unit time is high, an angle defined by the direction of injection of the auxiliary fuel and the plane in which the valve and the partition wall are arranged is set to be small.

According to the present invention, if injection of the auxiliary fuel by the auxiliary fuel injection valve is used in an area where the engine speed of the internal combustion engine is high, or in an area where the manifold pressure is high, or in an area where an amount of intake air per unit time is high, a velocity vector of the intake air flow acting on the injected auxiliary fuel becomes large. That is, as the velocity vector of the intake air flow is large, the injected auxiliary fuel is carried toward the combustion chamber, and less likely to reach the plate surface of the valve and the wall surface. Therefore, the angle defined by the direction of injection of the auxiliary fuel and the plane in which the valve and the partition wall are arranged is set to be small (the direction of injection is set to a direction opposing the flow of the intake air and to a further horizontal direction), so that the injected auxiliary fuel readily reaches the plate surface of the valve and the wall surface by virtue of its vector combined with the velocity vector of the large intake air flow. In this manner, the injected auxiliary fuel is divided into two: auxiliary fuel directly supplied to each cylinder; and auxiliary fuel injected toward the plate surface of the valve and toward the wall surface, once adhered to those surfaces, and thereafter supplied to each cylinder in a vaporized manner. Accordingly, the auxiliary fuel can uniformly be supplied to all cylinders.

A control device for an auxiliary fuel injection unit according to another aspect of the present invention controls an auxiliary fuel injection unit for an internal combustion engine having a structure according to any one of the inventions described above. The control device includes: a detection unit detecting an engine speed of the internal combustion engine; a detection unit detecting a pressure of intake air supplied to the internal combustion engine; and a control unit controlling the auxiliary fuel injection unit. The control unit determines whether or not injection of the auxiliary fuel is allowed based on the engine speed and the pressure at the time of start of the internal combustion engine. If it is determined that injection is allowed, the control unit causes the auxiliary fuel to be injected for a predetermined period of time from the auxiliary fuel injection valve.

According to the present invention, in an area where the engine speed at the time of start of the internal combustion engine is excessively high or in an area where the manifold pressure is excessively high, a force applied by a current of the intake air is excessively strong. Therefore, the auxiliary fuel injected from the auxiliary fuel injection valve is carried away by the air current and desired distribution cannot be obtained. In addition, in an area where the engine speed at the time of start of the internal combustion engine is excessively low or in an area where the manifold pressure is excessively low, a force applied by a current of the intake air is excessively weak. Therefore, an amount of the auxiliary fuel injected from the auxiliary fuel injection valve and not carried away by the air current is too large to obtain desired distribution. Therefore, the control device determines whether or not injection of the auxiliary fuel is allowed based on the engine speed and the pressure at the time of start of the internal combustion engine. As a result, a control device for an auxiliary fuel injection unit for an internal combustion engine attaining improvement in a cold start property can be provided in an internal combustion engine having a variable inlet pipe length system.

A control device for an auxiliary fuel injection unit according to yet another aspect of the present invention controls an auxiliary fuel injection unit for an internal combustion engine having a structure according to any one of the inventions described above. The control device includes a detection unit detecting an amount of intake air per unit time supplied to the internal combustion engine, and a control unit controlling the auxiliary fuel injection unit. The control unit determines whether or not injection of the auxiliary fuel is allowed based on an amount of intake air per unit time at the time of start of the internal combustion engine. If it is determined that the injection is allowed, the control unit causes the auxiliary fuel to be injected for a predetermined period of time from the auxiliary fuel injection valve.

According to the present invention, in an area where an amount of the intake air per unit time at the time of start of the internal combustion engine is excessively high, a force applied by a current of the intake air is excessively strong. Therefore, the auxiliary fuel injected from the auxiliary fuel injection valve is carried away by the air current and desired distribution cannot be obtained. In addition, in an area where an amount of the intake air per unit time at the time of start of the internal combustion engine is excessively low, a force applied by a current of the intake air is excessively weak. Therefore, an amount of the auxiliary fuel injected from the auxiliary fuel injection valve and not carried away by the air current is too large to obtain desired distribution. Therefore, the control device determines whether or not injection of the auxiliary fuel is allowed based on an amount of the intake air per unit time. As a result, a control device for an auxiliary fuel injection unit for an internal combustion engine attaining improvement in a cold start property can be provided in an internal combustion engine having a variable inlet pipe length system.

Preferably, if a predetermined condition is satisfied after injection of the auxiliary fuel, the control unit stops injection of the auxiliary fuel even during the predetermined period of time.

According to the present invention, for example, once the internal combustion engine is started, injection of the auxiliary fuel is no longer necessary. Here, a condition that the internal combustion engine has started is determined in advance. Then, injection of the auxiliary fuel is stopped even during the predetermined period of time for injection of the auxiliary fuel. Accordingly, unnecessary consumption of the auxiliary fuel can be suppressed.

More preferably, the condition refers to a condition that an operation to start the internal combustion engine has been completed.

According to the present invention, when the condition that the operation to start the internal combustion engine has been completed is satisfied, injection of the auxiliary fuel is stopped even during the predetermined period of time for injection of the auxiliary fuel. Accordingly, unnecessary consumption of the auxiliary fuel can be suppressed.

Further preferably, the condition refers to a condition that an operation to start the internal combustion engine has been completed, determined based on the engine speed of the internal combustion engine.

According to the present invention, as the engine speed is increased when the internal combustion engine attains detonation, it is possible to determine that the operation to start the internal combustion engine has been completed. When the operation to start the internal combustion engine has been completed, injection of the auxiliary fuel is stopped even during the predetermined period of time for injection of the auxiliary fuel. Accordingly, unnecessary consumption of the auxiliary fuel can be suppressed.

Further preferably, the condition refers to a condition that an operation to start the internal combustion engine has been completed, determined based on the pressure of the intake air supplied to the internal combustion engine.

According to the present invention, when the internal combustion engine attains detonation, the pressure of the intake air supplied to the internal combustion engine fluctuates. Accordingly, it is possible to determine that the operation to start the internal combustion engine has been completed. When the operation to start the internal combustion engine has been completed, injection of the auxiliary fuel is stopped even during the predetermined period of time for injection of the auxiliary fuel. Accordingly, unnecessary consumption of the auxiliary fuel can be suppressed.

Further preferably, the condition refers to a condition that an operation to start the internal combustion engine has been completed, determined based on an amount of intake air per unit time supplied to the internal combustion engine.

According to the present invention, when the internal combustion engine attains detonation, an amount of the intake air per unit time supplied to the internal combustion engine fluctuates. Accordingly, it is possible to determine that the operation to start the internal combustion engine has been completed. When the operation to start the internal combustion engine has been completed, injection of the auxiliary fuel is stopped even during the predetermined period of time for injection of the auxiliary fuel. Accordingly, unnecessary consumption of the auxiliary fuel can be suppressed.

Further preferably, the control device for the auxiliary fuel injection unit outputs a control signal to a control device controlling a fuel injection valve such that a timing for the auxiliary fuel supplied from the auxiliary fuel injection valve to a combustion chamber to reach the combustion chamber is in synchronization with a timing of fuel injection by the fuel injection valve injecting a fuel to the combustion chamber of the internal combustion engine.

According to the present invention, as the auxiliary fuel injection valve is provided in the upstream of the combustion chamber, it takes time for the auxiliary fuel to reach the combustion chamber. Therefore, fuel injection by the fuel injection valve provided in the combustion chamber is delayed until the auxiliary fuel reaches the combustion chamber. To that end, a control signal is output from the control device for the auxiliary fuel injection unit to the control device controlling the fuel injection valve at a timing of injection of the auxiliary fuel. In the control device controlling the fuel injection valve, after a delay time predetermined from that timing (time until the auxiliary fuel reaches the combustion chamber), the fuel is injected from the fuel injection valve provided in the combustion chamber (by an amount to attain one combustion by combining the auxiliary fuel injected from the auxiliary fuel injection valve with the fuel injected from the fuel injection valve in the combustion chamber). In this manner, the timing for the auxiliary fuel supplied from the auxiliary fuel injection valve to the combustion chamber to reach the combustion chamber can be in synchronization with the timing of fuel injection by the fuel injection valve injecting the fuel to the combustion chamber of the internal combustion engine.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
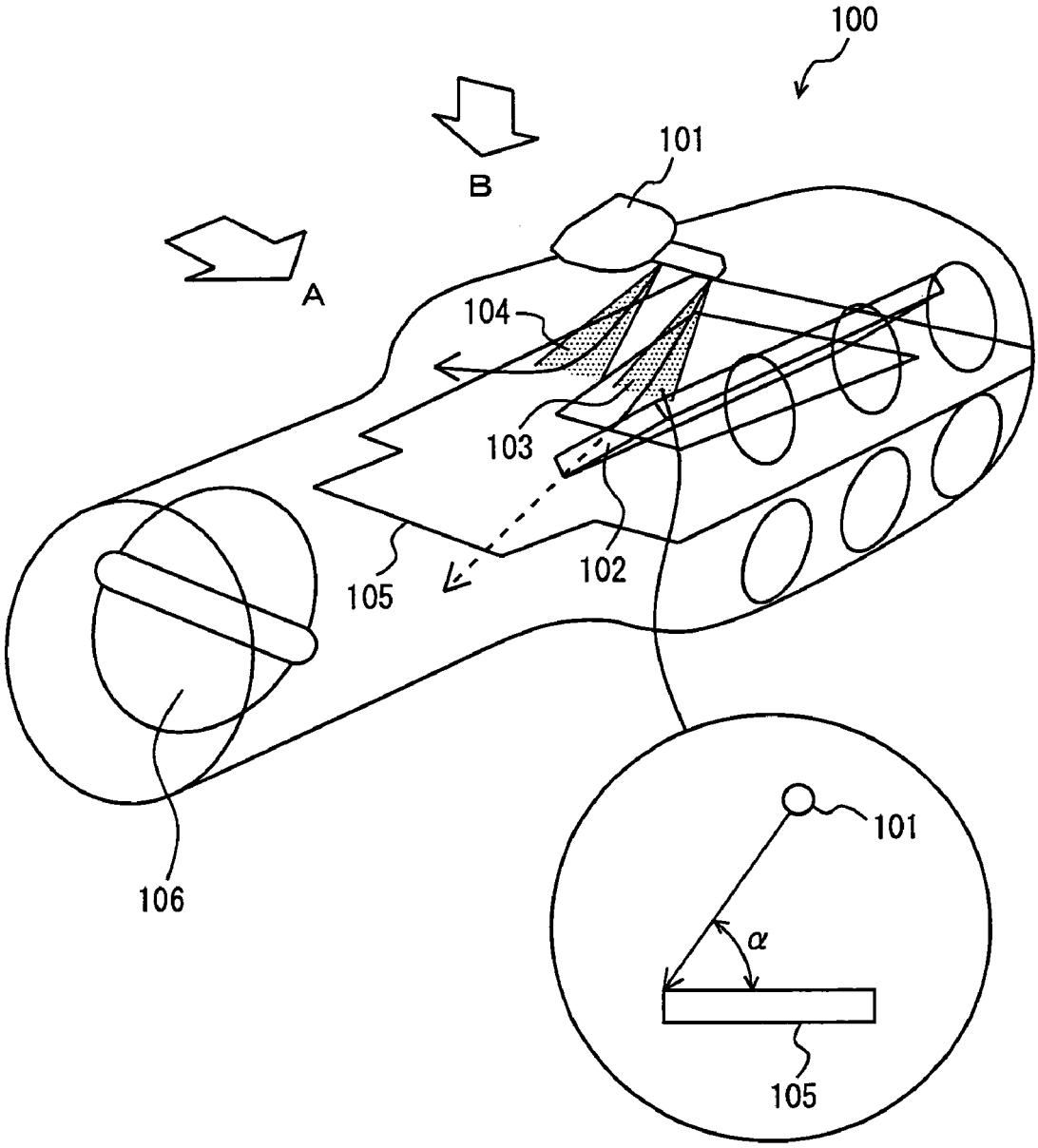
FIG. 1 is a perspective view of a surge tank having an auxiliary fuel injection unit according to a first embodiment of the present invention.

In the following, embodiments of the present invention will be described with reference to the figures. It is noted that the same reference characters refer to the same or corresponding components in the figures and their denotations and functions are also the same. Therefore, detailed description thereof will not be repeated.

Figure 2A:
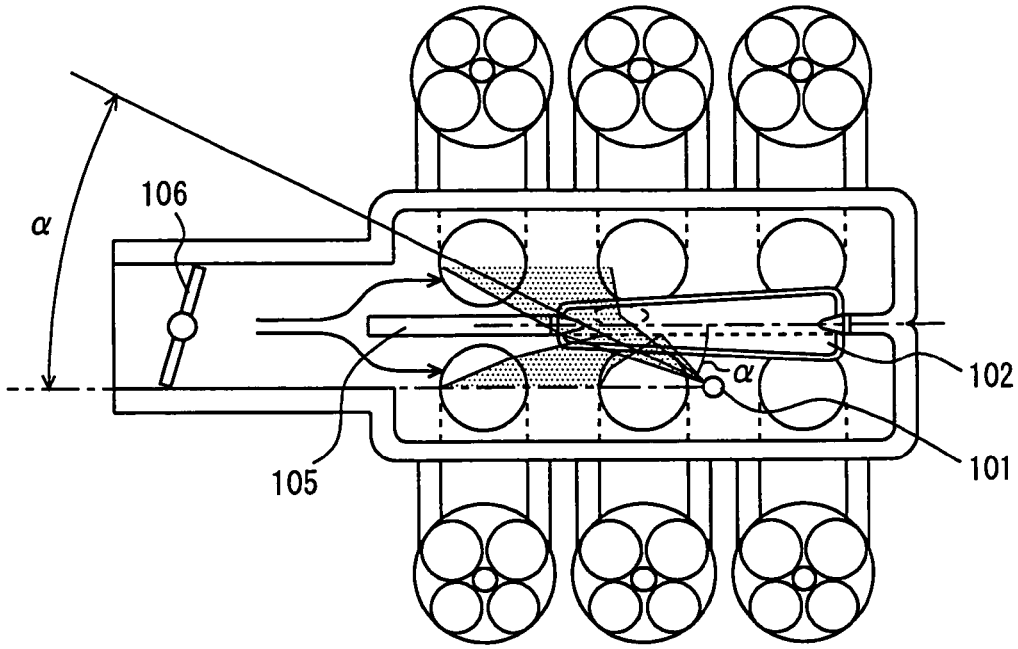
FIG. 2A is a plan view of FIG. 1.
Figure 2B:
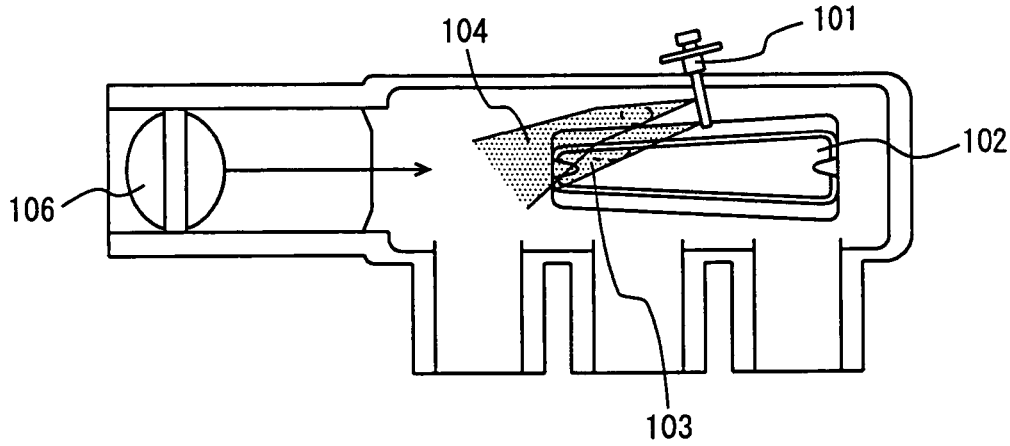
FIG. 2B is a side view of FIG. 1.

FIGS. 1 and 2 show a surge tank 100 having an auxiliary fuel injection unit according to the present embodiment. FIG. 2A shows a view from a direction shown with an arrow A in FIG. 1, while FIG. 2B shows a view from a direction shown with an arrow B in FIG. 1.

As shown in FIGS. 1 and 2, surge tank 100 is divided by a partition wall 105, and implements a plurality of surge tanks. Surge tank 100 has an integral structure partitioned by partition wall 105. A butterfly valve 102 is provided in partition wall 105. An auxiliary fuel injection valve 101 injecting the auxiliary fuel into surge tank 100 is provided.

Auxiliary fuel injection valve 101 has a shaft portion, of which longitudinal direction is perpendicular to an air intake, and the shaft portion has two injection holes connecting with each other. Spray 103 injected through the first injection hole once impinges on the plate surface forming the valve of butterfly valve 102, and fills surge tank 100 on a side where auxiliary fuel injection valve 101 is not provided (lower portion in FIG. 1) with the auxiliary fuel. In addition, spray 104 injected through the other second injection hole once impinges on surge tank partition wall 105, and fills surge tank 100 on a side where auxiliary fuel injection valve 101 is present with the auxiliary fuel. Here, the number of injection holes provided in the auxiliary fuel injection valve is not limited, provided that spray in two directions as described above can be formed. In order to avoid cost increase, however, a single auxiliary fuel injection valve is preferably provided. In particular, if two injection holes are provided as described above, the holes preferably connect with each other. Then, two injection holes connect with each other and open toward a direction opposing the flow of the intake air. Accordingly, removal of the fuel inside the injection hole is facilitated, and solidification of remaining fuel due to chemical reaction and adhesion of a combustion product in a gas blown into surge tank 100 can be prevented.

Butterfly valve 102 utilizes a structure of the variable inlet pipe length system. In addition, as shown in FIGS. 1 and 2, a throttle valve 106 controlling a flow rate of the intake air is provided at an inlet of surge tank 100.

As shown in FIGS. 1 and 2, an angle formed by surge tank partition wall 105 and the spray injected through the injection hole in the auxiliary fuel injection valve is defined as $\alpha$. Angle $\alpha$ is set such that angle $\alpha$ becomes larger as the auxiliary fuel injection valve is distanced from surge tank partition wall 105 or as the angle of spread of the spray through the injection hole in the auxiliary fuel injection valve becomes larger. In addition, if the auxiliary fuel injection valve is used in an area where the engine speed of the internal combustion engine is high, in an area where a manifold pressure is high, or in an area where an amount of the intake air is high, angle $\alpha$ is set to be small.

By setting angle $\alpha$ to be small in such a manner, spray 103 and spray 104 injected through the injection holes are prevented from being carried away by the intake air flow as well as from flowing into the combustion chamber without reaching surge tank partition wall 105 and butterfly valve 102. Here, angle $\alpha$ will be described from another aspect, referring to FIG. 3.

Figure 3:
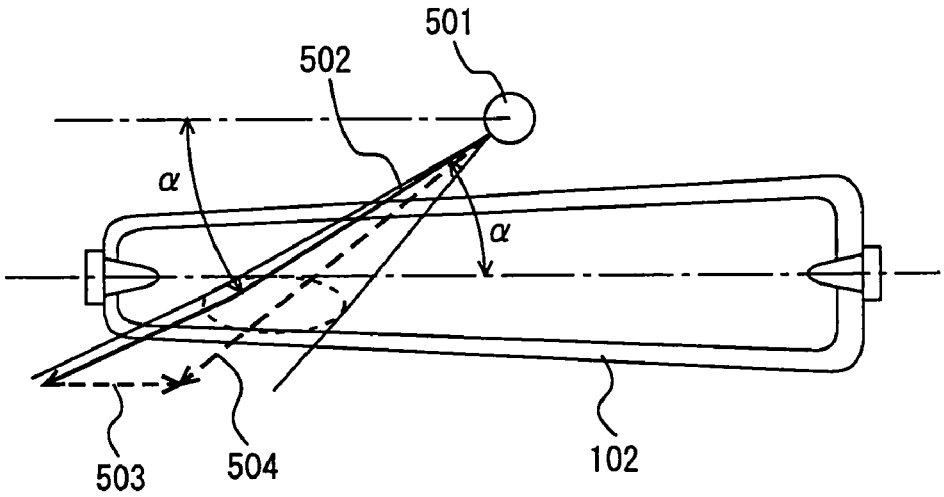
FIG. 3 illustrates a spray angle $\alpha$.

In a method of defining angle $\alpha$ representing a direction of injection of the auxiliary fuel through the injection hole shown in FIG. 3 (hereinafter, angle $\alpha$ may be denoted as an "injection angle $\alpha$"), as a range of injection operation is set to an area of a higher engine speed, an area of a higher amount of the intake air, or an area under a higher manifold pressure, injection angle $\alpha$ is set smaller. In this manner, push-back by a stronger opposing air current can be cancelled by the traveling force of the spray toward the upstream. In other words, as shown in FIG. 3, a combined vector 504 of an injection direction velocity vector 502 at angle $\alpha$ through injection hole 501 with a velocity vector 503 of the air current represents a spray travel vector. Here, angle $\alpha$ is defined such that the spray travel vector extends to a cylinder inlet position on a most upstream side in accordance with the air current at an assumed engine speed. If a spray length is set so as to extend to the air intake position, the spray that has lost its speed on the upstream side can form an air-fuel mixture utilizing the air current. In this manner, the fuel is taken into each cylinder, in synchronization with suction of the air.

Here, it is also possible to reduce unnecessary main injection by calculating in advance a time necessary for the auxiliary fuel injected from the auxiliary fuel injection valve to reach the combustion chamber and by delaying injection by a main injector provided in each cylinder from the start of injection by the auxiliary fuel injection valve until an expected arrival time.

Figure 4:
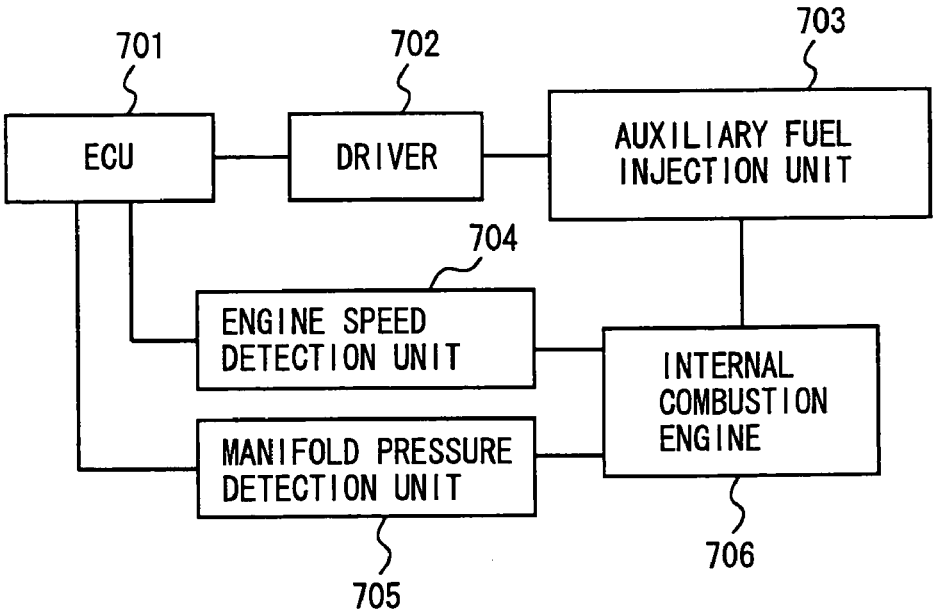
FIG. 4 is a control block diagram of a control device for the auxiliary fuel injection unit according to the first embodiment of the present invention.

FIG. 4 shows a control block diagram of a control device for the auxiliary fuel injection unit according to the present embodiment.

As shown in FIG. 4, the control device includes an ECU (Electronic Control Unit) 701, a driver 702 connected to ECU 701, an auxiliary fuel injection unit 703, an engine speed detection unit 704 detecting the engine speed of an internal combustion engine 706, and a manifold pressure detection unit 705 detecting a pressure of the intake air into internal combustion engine 706. Engine speed detection unit 704 and manifold pressure detection unit 705 input detected signals to ECU 701 respectively.

Figure 5:
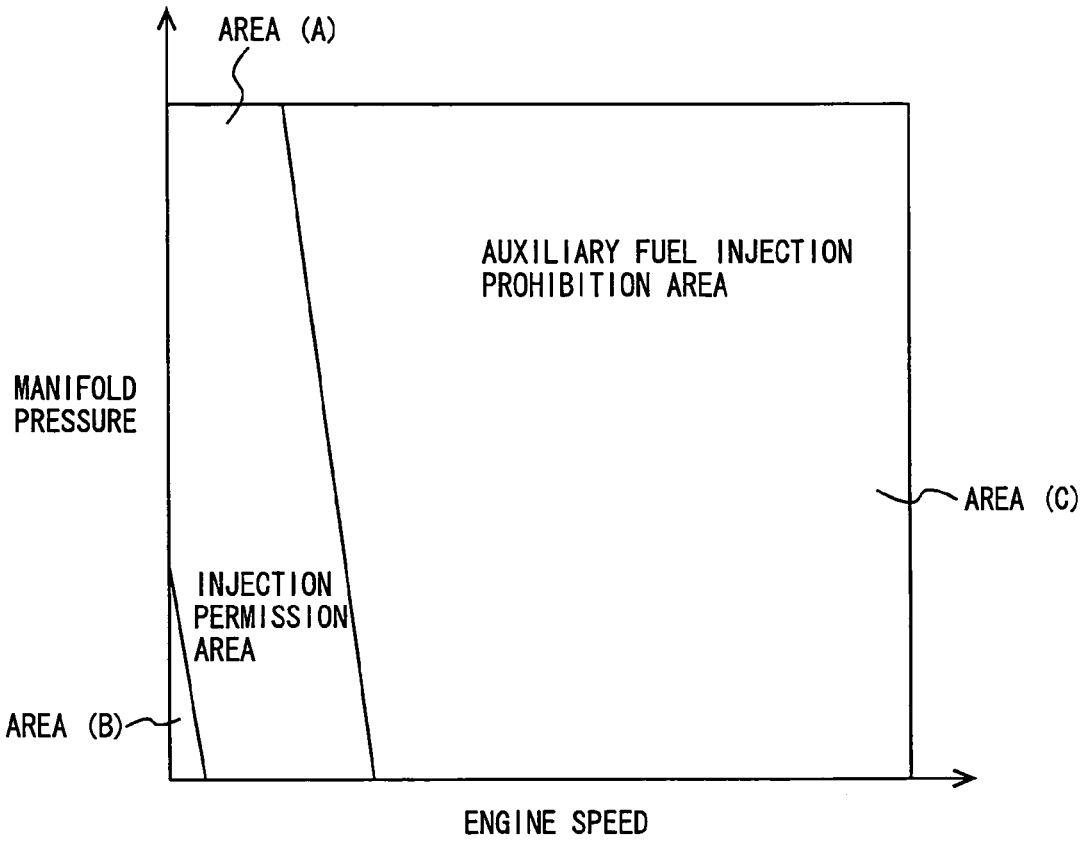
FIG. 5 illustrates a map stored in an ECU in FIG. 4.

FIG. 5 illustrates a map stored in an internal memory of ECU 701. The map shown in FIG. 5, in which the abscissa represents an engine speed and the ordinate represents a manifold pressure, defines an area in which injection from the auxiliary fuel injection valve is prohibited and an area in which injection from the auxiliary fuel injection valve is permitted. An area (A) represents area in which injection from the auxiliary fuel injection valve is prohibited, while areas (B) and (C) represent the area in which injection from the auxiliary fuel injection valve is permitted.

As shown in FIG. 5, if the engine speed is high or if the manifold pressure is high, the fuel injected from the auxiliary fuel injection valve is carried toward the combustion chamber without reaching partition wall 105 of surge tank 100 or butterfly valve 102. Therefore, injection from the auxiliary fuel injection valve is prohibited. Meanwhile, if a flow is weaker than the assumed air current and distribution of the auxiliary fuel to each cylinder is not uniform as in area (B), injection from the auxiliary fuel injection valve is prohibited.

Figure 6:
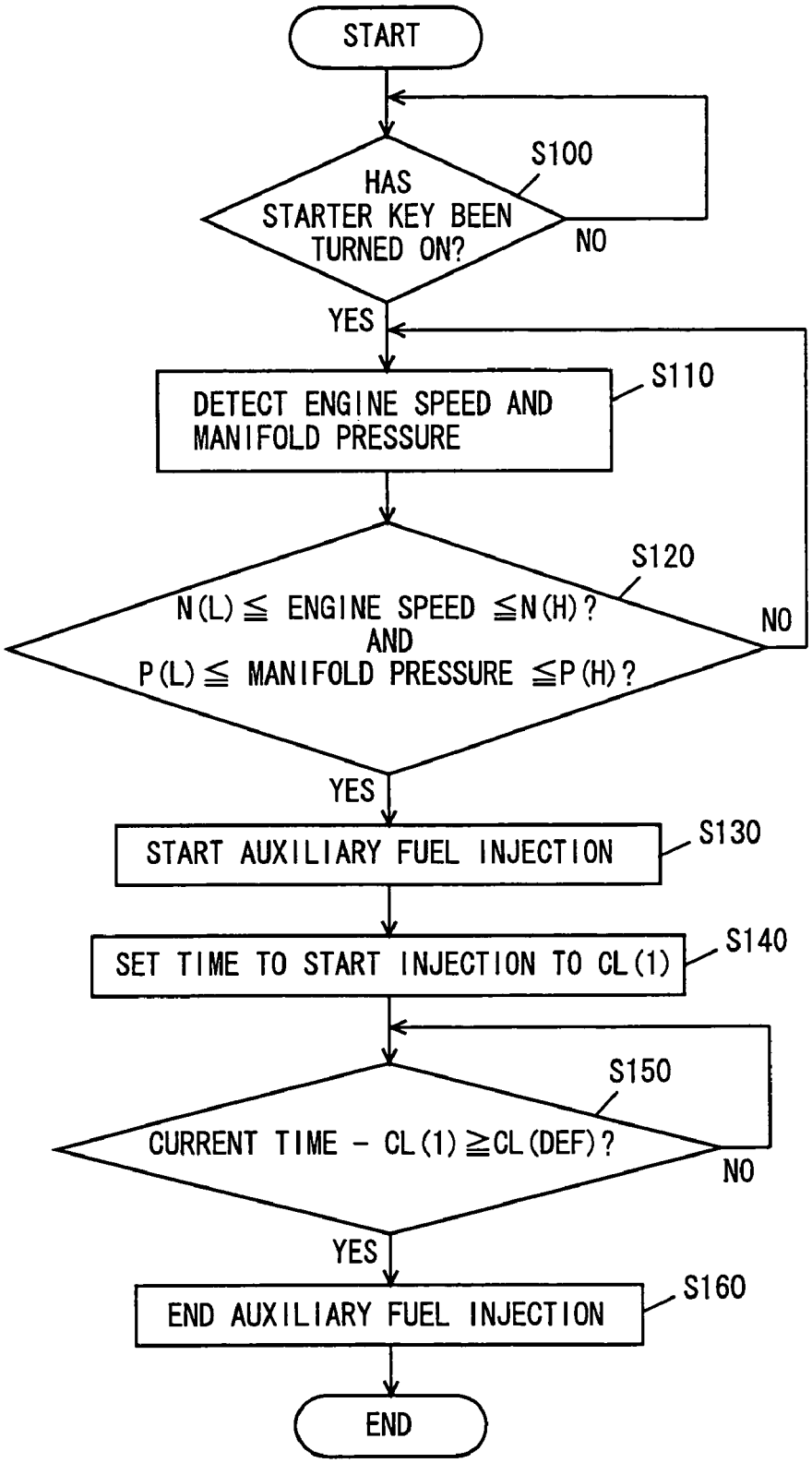
FIG. 6 is a flowchart illustrating a control configuration of a program executed in the control device for the auxiliary fuel injection unit according to the first embodiment of the present invention.

FIG. 6 is a flowchart illustrating a control configuration of a program executed in ECU 701 in FIG. 4.

At step (hereinafter, step is abbreviated as "S") 100, ECU 701 determines whether or not the starter key has been turned on. When the starter key is turned on (YES at S100), the process proceeds to S110. Otherwise (NO at S100), the process returns to S100.

At S110, ECU 701 detects the engine speed of the internal combustion engine and the manifold pressure. Here, ECU 701 detects the engine speed of the internal combustion engine and the manifold pressure based on signals input from engine speed detection unit 704 and manifold pressure detection unit 705, respectively.

At S120, ECU 701 determines whether or not N(L) ≦engine speed≦N(H) and P(L)≦manifold pressure≦P(H) are satisfied. Here, N(L), N(H), P(L), and P(H) represent predetermined threshold values of the engine speed and the manifold pressure respectively, corresponding to the map in FIG. 5. In other words, whether or not the engine speed of the internal combustion engine and the manifold pressure are within a predetermined range is determined. If the engine speed and the manifold pressure are within a predetermined range (YES at S120), the process proceeds to S130. Otherwise (NO at S120), the process returns to S110.

At S130, ECU 701 starts injection of the auxiliary fuel by turning on the auxiliary fuel injection valve. At S140, ECU 701 sets a time to start injection to CL(1).

At S150, ECU 701 determines whether or not current time—CL(1)≧CL(DEF). Here, CL(DEF) represents a predetermined time period for auxiliary fuel injection. If current time—CL(1)≧CL(DEF) is satisfied (YES at S150), the process proceeds to S160. Otherwise (NO at S150), the process returns to S150.

At S160, ECU 701 ends injection of the auxiliary fuel from the auxiliary fuel injection valve.

An operation of the auxiliary fuel injection unit and the control device for the same according to the present embodiment based on the structure and the flowchart described above will now be discussed.

When the starter key is turned on at the time of cold start (YES at S100), the engine speed and the manifold pressure are detected. If the engine speed and the manifold pressure are within a predetermined range (YES at S120), injection of the auxiliary fuel using the auxiliary fuel injection valve is started (S130). Here, if the engine speed and the manifold pressure are in area (A) based on the map shown in FIG. 5, injection of the auxiliary fuel is started using the auxiliary fuel injection valve.

The auxiliary fuel is injected until a predetermined time period for auxiliary fuel injection CL(DEF) has passed. If the predetermined time period has passed (YES at S150), injection of the auxiliary fuel ends (S160).

Figure 7:
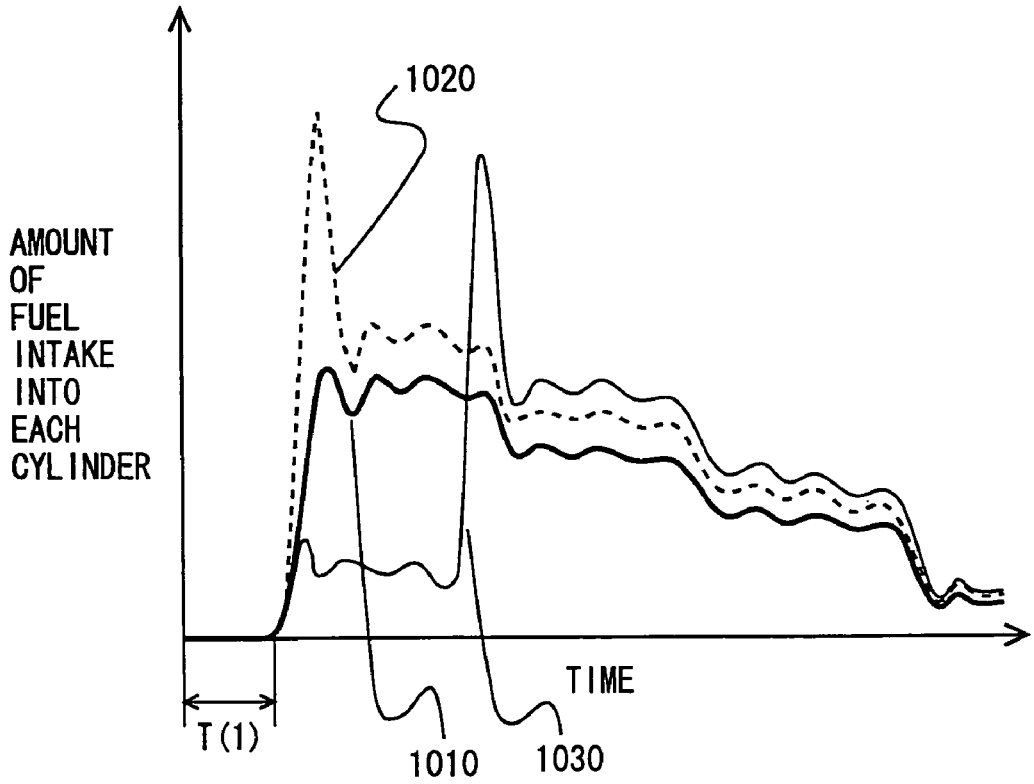
FIG. 7 is a timing chart illustrating an operation in the auxiliary fuel injection unit according to the first embodiment of the present invention.

FIG. 7 shows variation in an amount of fuel intake into each cylinder over time in such a case. According to the auxiliary fuel injection unit and the control device for the same in the present embodiment, a uniform amount of fuel intake is achieved, as shown with a waveform 1010. For the sake of comparison, FIG. 7 also shows waveforms 1020 and 1030. Waveform 1020 represents an example in which the auxiliary fuel is directly injected from the auxiliary fuel injection valve toward the downstream side of the intake air current and an amount of fuel intake instantaneously increases. That is, most part of the spray is instantaneously suctioned directly into a specific cylinder. Meanwhile, waveform 1030 represents an example in which the auxiliary fuel injection valve is provided around an area immediately behind the throttle valve and a distance from the auxiliary fuel injection valve to each combustion chamber is long. As the distance from the auxiliary fuel injection valve to the combustion chamber is long, a time delay is caused in the amount of fuel intake into each cylinder, resulting in poor starting property.

It is noted that a time T(1) shown in FIG. 7 represents a time for the auxiliary fuel to reach the combustion chamber from the auxiliary fuel injection valve in the auxiliary fuel injection unit according to the present embodiment. By delaying a timing of fuel injection by the fuel injection valve injecting the fuel into the combustion chamber by time T(1), a timing for the auxiliary fuel to reach the combustion chamber from the auxiliary fuel injection valve can be in synchronization with a timing of injection by the fuel injection valve in the combustion chamber.

As described above, according to the auxiliary fuel injection unit of the present embodiment, one auxiliary fuel injection valve having two injection holes is provided in the surge tank of the internal combustion engine having the variable inlet pipe length system, so that the auxiliary fuel can uniformly be distributed to each cylinder with excellent response even in the divided surge tank.

<First Embodiment Variation>

In the following, a variation of the auxiliary fuel control device according to the first embodiment will be described. Here, the present variation has a hardware configuration the same as that in the first embodiment, and it is different from the first embodiment only in a portion of a program executed in ECU 701. As the present variation is otherwise similar to the first embodiment, detailed description thereof will not be repeated.

Figure 8:
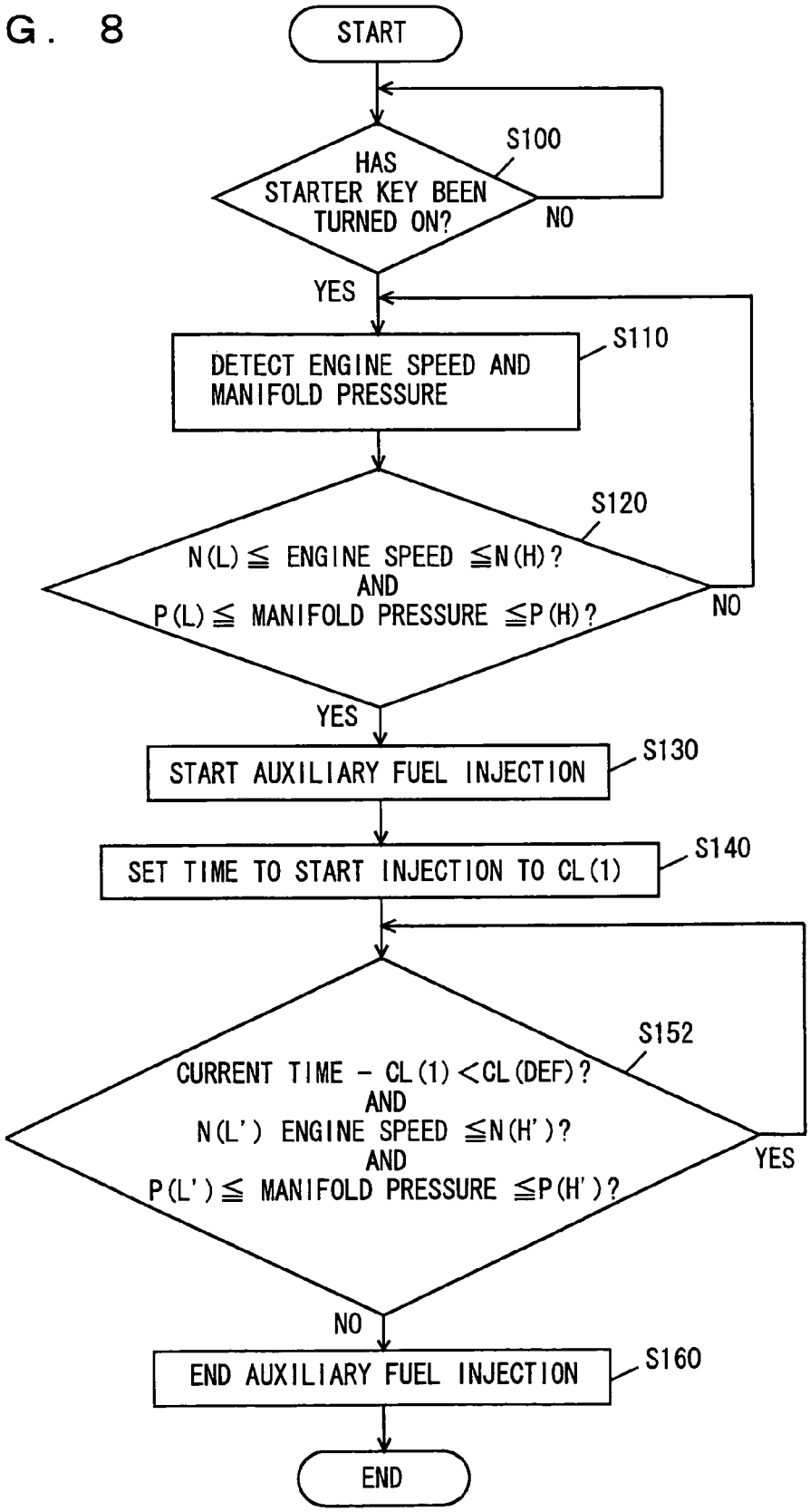
FIG. 8 is a flowchart illustrating a control configuration of a program executed in a control device for an auxiliary fuel injection unit according to a variation of the first embodiment of the present invention.

Referring to FIG. 8, a control configuration of a program executed in ECU 701 serving as a control device for an auxiliary fuel injection unit according to the present variation will be described. It is noted that a processing in the flowchart shown in FIG. 8 similar to that in the flowchart shown in FIG. 6 above is given the same step number, and the processing is also the same. Therefore, detailed description thereof will not be repeated.

At S152, ECU 701 determines whether or not current time—CL(1)<CL(DEF) and N(L')≦engine speed≦N(H') and P(L')≦manifold pressure≦P(H') are satisfied. Here, N(L'), N(H'), P(L'), and P(H') represent predetermined threshold values of the engine speed and the manifold pressure for determining termination of injection of the auxiliary fuel, respectively. In other words, whether or not the engine speed of the internal combustion engine and the manifold pressure are within a predetermined range is determined even before predetermined time period for auxiliary fuel injection CL(DEF) has passed. If the engine speed and the manifold pressure reach a predetermined range even before the time period for auxiliary fuel injection has passed, it is determined that the operation to start the internal combustion engine has been completed (NO at S152), and injection of the auxiliary fuel from the auxiliary fuel injection valve is stopped (S160). Otherwise (YES at S152), the process returns to S152.

As described above, according to the present variation, even during the predetermined time period for auxiliary fuel injection, injection of the auxiliary fuel is stopped when the start of the internal combustion engine is detected based on variation in the engine speed or the manifold pressure. In this manner, unnecessary injection of the auxiliary fuel can be avoided, thereby improving fuel efficiency.

<Second Embodiment>

In the following, an auxiliary fuel control device according to the second embodiment will be described. Here, the present embodiment has a hardware configuration the same as that in the first embodiment except for a control block, and it is different from the first embodiment in a program executed in the ECU. As the present embodiment is otherwise similar to the first embodiment, detailed description thereof will not be repeated.

Figure 9:
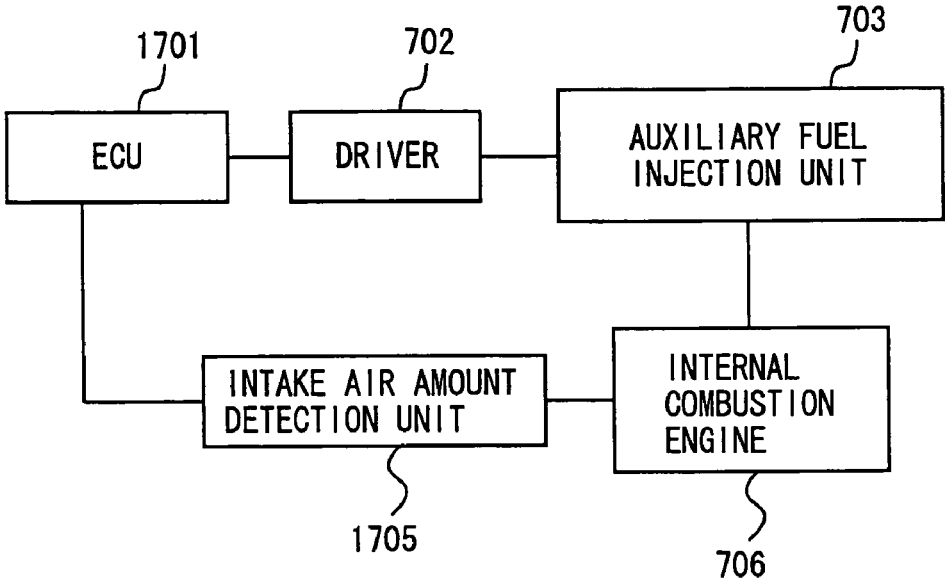
FIG. 9 is a control block diagram of a control device for an auxiliary fuel injection unit according to a second embodiment of the present invention.

FIG. 9 is a control block diagram of a control device for an auxiliary fuel injection unit according to the present embodiment. The component in the control block diagram shown in FIG. 9 similar to that in the control block diagram shown in FIG. 4 above is given the same reference numeral, and its function is also the same. Therefore, detailed description thereof will not be repeated.

As shown in FIG. 9, the control device for the auxiliary fuel injection unit according to the present embodiment includes an ECU 1701 executing a program different from that executed by ECU 701 in the first embodiment described above and an intake air amount detection unit 1705 detecting an amount of intake air per unit time supplied to internal combustion engine 706, without including the engine speed detection unit and the manifold pressure detection unit.

Figure 10:
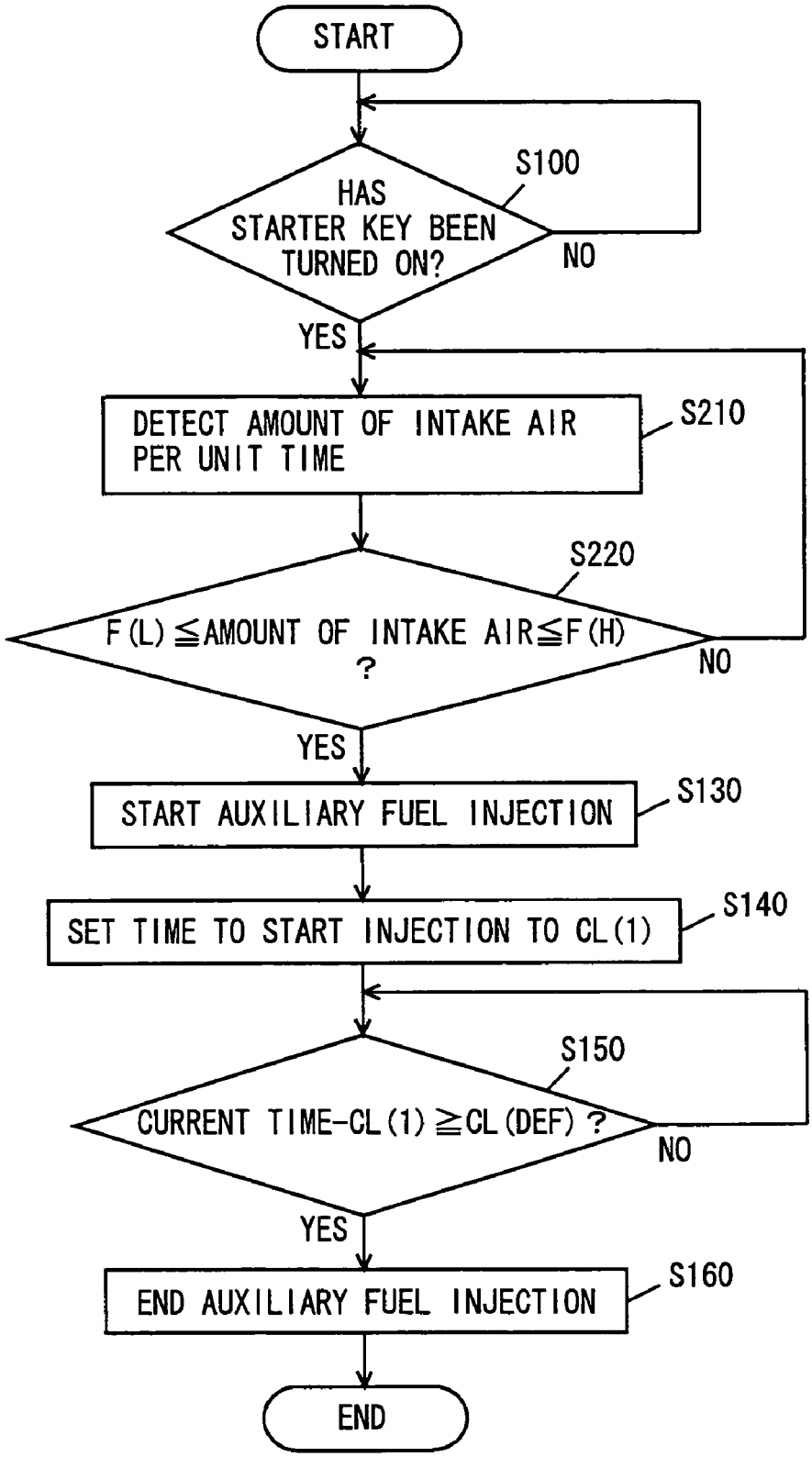
FIG. 10 is a flowchart illustrating a control configuration of a program executed in the control device for the auxiliary fuel injection unit according to the second embodiment of the present invention.

Referring to FIG. 10, a control configuration of a program executed in ECU 1701 serving as a control device for an auxiliary fuel injection unit according to the present embodiment will be described. It is noted that a processing in the flowchart shown in FIG. 10 similar to that in the flowchart shown in FIG. 6 is given the same step number, and the processing is also the same. Therefore, detailed description thereof will not be repeated.

FIG. 10 is a flowchart illustrating a control configuration of a program executed in ECU 1701 in FIG. 9. This program is different from the program in the first embodiment in that the processings at S110 and S120 in the first embodiment are replaced with processings at S210 and S220 in the second embodiment.

At S210, ECU 1701 detects an amount of intake air into the internal combustion engine per unit time. Here, ECU 1701 detects an amount of intake air into the internal combustion engine per unit time based on a signal input from intake air amount detection unit 1705.

At S220, ECU 1701 determines whether or not F(L)≦an amount of intake air≦F(H). Here, F(L) and F(H) represent threshold values of the amount of intake air per predetermined unit time, respectively. That is, intake air amount detection unit 1705 detects an amount of intake air per unit time supplied to internal combustion engine 706, so as to determine whether or not that amount is within a predetermined range. If F(L)≦an amount of intake air≦F(H) (YES at S220), the process proceeds to S130. Otherwise (NO at S220), the process returns to S110.

An operation of the control device for the auxiliary fuel injection unit according to the present embodiment based on the structure and the flowchart described above will now be discussed.

When the starter key is turned on (YES at S100) and when an amount of intake air per unit time is within the predetermined range (YES at S220), injection of the auxiliary fuel by the auxiliary fuel injection valve is carried out. Here, the auxiliary fuel is injected until predetermined time period for auxiliary fuel injection CL(DEF) has passed.

As described above, according to the control device for the auxiliary fuel injection unit of the present embodiment, whether or not injection of the auxiliary fuel is allowed, that has been determined based on the engine speed of the internal combustion engine and the manifold pressure in the control device for the auxiliary fuel injection unit according to the first embodiment described above, can be determined based on an amount of intake air per unit time.

<Second Embodiment Variation>

In the following, a variation of the auxiliary fuel control device according to the second embodiment will be described. Here, the present variation has a hardware configuration the same as that in the second embodiment, and it is different from the second embodiment only in a portion of a program executed in ECU 1701. As the present variation is otherwise similar to the first embodiment, detailed description thereof will not be repeated.

Figure 11:
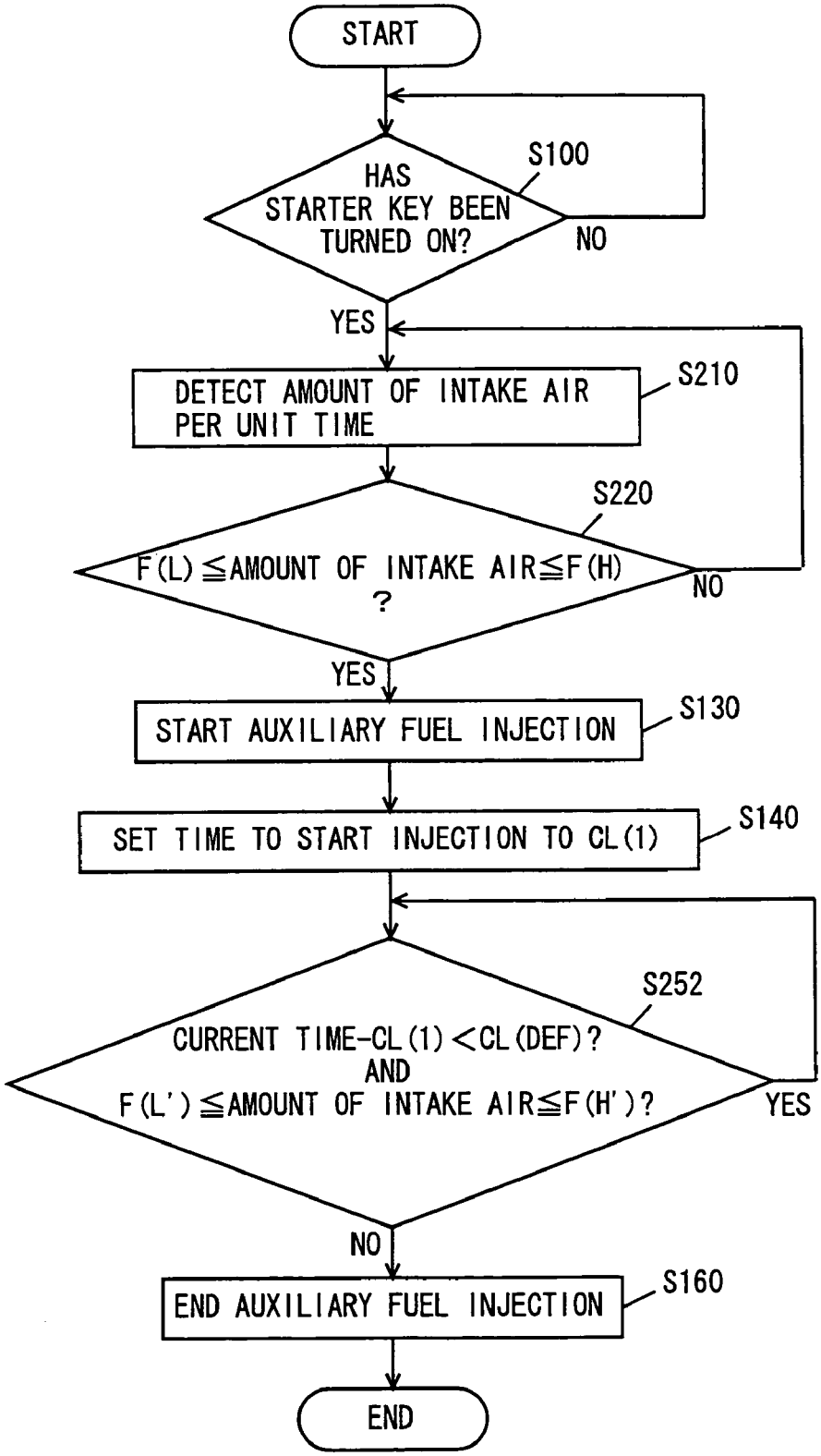
FIG. 11 is a flowchart illustrating a control configuration of a program executed in a control device for an auxiliary fuel injection unit according to a variation of the second embodiment of the present invention.

FIG. 11 shows a control configuration of a program in the present variation. It is noted that a processing in the flowchart shown in FIG. 11 similar to that in the flowchart shown in FIG. 10 above is given the same step number, and the processing is also the same. Therefore, detailed description thereof will not be repeated.

At S252, whether or not current time—CL(1)<CL(DEF) and F(L')≦an amount of intake air≦F(H') are satisfied is determined. Here, F(L') and F(H') represent predetermined threshold values of the amount of intake air per unit time for determining termination of injection of the auxiliary fuel, respectively. In other words, whether or not the amount of intake air per unit time is within a predetermined range is determined even before predetermined time period for auxiliary fuel injection CL(DEF) has passed. If the amount of intake air per unit time reaches a predetermined range even before the time period for auxiliary fuel injection has passed, it is determined that the operation to start the internal combustion engine has been completed (NO at S252), and injection of the auxiliary fuel from the auxiliary fuel injection valve is stopped (S160). Otherwise (YES at S252), the process returns to S252.

As described above, according to the present variation, even during the predetermined time period for auxiliary fuel injection, injection of the auxiliary fuel is stopped when the predetermined amount of intake air per unit time is attained (that is, when the operation to start the internal combustion engine has been completed). In this manner, poorer fuel efficiency due to unnecessary injection of the auxiliary fuel can be avoided.

Although the present invention has been described and illustrated in detail, it is clearly understood that the same is by way of illustration and example only and is not to be taken by way of limitation, the spirit and scope of the present invention being limited only by the terms of the appended claims.

The invention claimed is:

1. An auxiliary fuel injection unit in an internal combustion engine comprising:

a plurality of surge tanks partitioned by a wall surface;

a valve for switching between connection and disconnection of said surge tanks;

an auxiliary fuel injection valve for injecting an auxiliary fuel in a direction opposing a direction of flow of intake air within said surge tank; and said auxiliary fuel injection valve has an injection hole for injecting the auxiliary fuel toward said valve and toward said wall surface.

2. The auxiliary fuel injection unit according to claim 1, wherein said valve is implemented by a butterfly valve opening and closing an connect portion of said surge tanks.

3. The auxiliary fuel injection unit according to claim 1, wherein said auxiliary fuel injection valve has a shaft portion extending in parallel to a plane including said wall surface and perpendicular to said rotation shaft, said shaft portion has two injection holes aligned in a direction in which said shaft portion extends, and a first injection hole opens toward the plate surface of said valve and a second injection hole opens toward said wall surface.

4. The auxiliary fuel injection unit according to claim 3, wherein said two injection holes connect with each other.

5. The auxiliary fuel injection unit according to claim 1, wherein a direction of injection of the auxiliary fuel through said injection hole is in parallel to the flow of the intake air and set in a range from the direction opposing the flow of the intake air to a direction of the plane including said valve and said wall surface.

6. The auxiliary fuel injection unit according to claim 5, wherein as said auxiliary fuel injection valve is distanced from said valve and said wall surface, an angle defined by the direction of injection of said auxiliary fuel and the plane in which said valve and a partition wall are arranged is set to be large.

7. The auxiliary fuel injection unit according to claim 5, wherein as an angle of spread of spray of the auxiliary fuel through the injection hole of said auxiliary fuel injection valve is large, an angle defined by the direction of injection of said auxiliary fuel and the plane in which said valve and said partition wall are arranged is set to be large.

8. The auxiliary fuel injection unit according to claim 5, wherein if injection of the auxiliary fuel by said auxiliary fuel injection valve is used in an area where an engine speed of said internal combustion engine is high, or in an area where a manifold pressure is high, or in an area where an amount of intake air per unit time is high, an angle defined by the direction of injection of said auxiliary fuel and the plane in which said valve and said partition wall are arranged is set to be small.

9. A control device for an auxiliary fuel injection unit for an internal combustion engine; wherein said auxiliary fuel injection unit for an internal combustion engine includes a plurality of surge tanks partitioned by a wall surface, a valve for switching between connection and disconnection of said surge tanks, and an auxiliary fuel injection valve for injecting an auxiliary fuel in a direction opposing a direction of flow of intake air within said surge tank, said valve has a plate surface closing an opening connect portion of surge tanks provided in said wall surface and a rotation shaft for turning said plate surface, said auxiliary fuel injection valve has an injection hole for injecting the auxiliary fuel toward the plate surface of said valve and toward said wall surface, said control device comprises a detection unit detecting an engine speed of said internal combustion engine, a detection unit detecting a pressure of intake air supplied to said internal combustion engine, and a control unit controlling said auxiliary fuel injection unit, and said control unit determines whether injection of said auxiliary fuel is allowed based on the engine speed and the pressure at a time of start of said internal combustion engine, and if it is determined that said injection is allowed, said control unit causes the auxiliary fuel to be injected for a predetermined period of time from said auxiliary fuel injection valve.

10. A control device for an auxiliary fuel injection unit for an internal combustion engine; wherein said auxiliary fuel injection unit for an internal combustion engine includes a plurality of surge tanks partitioned by a wall surface, a valve for switching between connection and disconnection of said surge tanks, and an auxiliary fuel injection valve for injecting an auxiliary fuel in a direction opposing a direction of flow of intake air within said surge tank, said valve has a plate surface closing an opening connect portion of surge tanks provided in said wall surface and a rotation shaft for turning said plate surface, said auxiliary fuel injection valve has an injection hole for injecting the auxiliary fuel toward the plate surface of said valve and toward said wall surface, said control device comprises a detection unit detecting an amount of intake air per unit time supplied to said internal combustion engine, and a control unit controlling said auxiliary fuel injection unit, and said control unit determines whether injection of said auxiliary fuel is allowed based on an amount of intake air per unit time at a time of start of said internal combustion engine, and if it is determined that said injection is allowed, said control unit causes the auxiliary fuel to be injected for a predetermined period of time from said auxiliary fuel injection valve.

11. The control device according to claim 10, wherein if a predetermined condition is satisfied after injection of said auxiliary fuel, said control unit stops injection of said auxiliary fuel even during the predetermined period of time.

12. The control device according to claim 11, wherein said condition refers to a condition that an operation to start said internal combustion engine has been completed.

13. The control device according to claim 11, wherein said condition refers to a condition that an operation to start said internal combustion engine has been completed, determined based on the engine speed of said internal combustion engine.

14. The control device according to claim 11, wherein said condition refers to a condition that an operation to start said internal combustion engine has been completed, determined based on the pressure of the intake air supplied to said internal combustion engine.

15. The control device according to claim 11, wherein said condition refers to a condition that an operation to start said internal combustion engine has been completed, determined based on an amount of intake air per unit time supplied to said internal combustion engine.

16. The control device according to claim 9, wherein said control device outputs a control signal to a control device controlling a fuel injection valve such that a timing for the auxiliary fuel supplied from said auxiliary fuel injection valve to a combustion chamber to reach the combustion chamber is in synchronization with a timing of fuel injection by said fuel injection valve injecting a fuel to the combustion chamber of said internal combustion engine.

17. A control device for an auxiliary fuel injection unit for an internal combustion engine; wherein said auxiliary fuel injection unit for an internal combustion engine includes a plurality of surge tanks partitioned by a wall surface, a valve for switching between connection and disconnection of said surge tanks, and an auxiliary fuel injection valve for injecting an auxiliary fuel in a direction opposing a direction of flow of intake air within said surge tank, said valve has a plate surface closing an opening connect portion of surge tanks provided in said wall surface and a rotation shaft for turning said plate surface, said auxiliary fuel injection valve has an injection hole for injecting the auxiliary fuel toward the plate surface of said valve and toward said wall surface, said control device comprises an engine speed detection unit detecting an engine speed of said internal combustion engine, a manifold pressure detection unit detecting a pressure of intake air supplied to said internal combustion engine, and an electronic control unit controlling said auxiliary fuel injection unit, and said electronic control unit determines whether injection of said auxiliary fuel is allowed based on the engine speed and the pressure at a time of start of said internal combustion engine, and if it is determined that said injection is allowed, said electronic control unit causes the auxiliary fuel to be injected for a predetermined period of time from said auxiliary fuel injection valve.

18. A control device for an auxiliary fuel injection unit for an internal combustion engine; wherein said auxiliary fuel injection unit for an internal combustion engine includes a plurality of surge tanks partitioned by a wall surface, a valve for switching between connection and disconnection of said surge tanks, and an auxiliary fuel injection valve for injecting an auxiliary fuel in a direction opposing a direction of flow of intake air within said surge tank, said valve has a plate surface closing an opening connect portion of surge tanks provided in said wall surface and a rotation shaft for turning said plate surface, said auxiliary fuel injection valve has an injection hole for injecting the auxiliary fuel toward the plate surface of said valve and toward said wall surface, said control device comprises an intake air amount detection unit detecting an amount of intake air per unit time supplied to said internal combustion engine, and an electronic control unit controlling said auxiliary fuel injection unit, and said electronic control unit determines whether injection of said auxiliary fuel is allowed based on an amount of intake air per unit time at a time of start of said internal combustion engine, and if it is determined that said injection is allowed, said electronic control unit causes the auxiliary fuel to be injected for a predetermined period of time from said auxiliary fuel injection valve.

19. The control device according to claim 18, wherein if a predetermined condition is satisfied after injection of said auxiliary fuel, said electronic control unit stops injection of said auxiliary fuel even during the predetermined period of time.

20. The control device according to claim 19, wherein said condition refers to a condition that an operation to start said internal combustion engine has been completed.

21. The control device according to claim 19, wherein said condition refers to a condition that an operation to start said internal combustion engine has been completed, determined based on the engine speed of said internal combustion engine.

22. The control device according to claim 19, wherein said condition refers to a condition that an operation to start said internal combustion engine has been completed, determined based on the pressure of the intake air supplied to said internal combustion engine.

23. The control device according to claim 19, wherein said condition refers to a condition that an operation to start said internal combustion engine has been completed, determined based on an amount of intake air per unit time supplied to said internal combustion engine.

24. The control device according to claim 17, wherein said control device outputs a control signal to a control device controlling a fuel injection valve such that a timing for the auxiliary fuel supplied from said auxiliary fuel injection valve to a combustion chamber to reach the combustion chamber is in synchronization with a timing of fuel injection by said fuel injection valve injecting a fuel to the combustion chamber of said internal combustion engine.

* * * * *